US008454809B2

(12) United States Patent
Maldonado Ramirez De Arellano

(10) Patent No.: US 8,454,809 B2
(45) Date of Patent: Jun. 4, 2013

(54) MODULAR CONTAINER ASSEMBLY FOR CORROSIVE SOLUTIONS

(75) Inventor: Miguel Maldonado Ramirez De Arellano, Santiago (CL)

(73) Assignee: Novel Composites Technologies S.A., Santiago (CL)

( * ) Notice: Subject to any disclaimer, the term of this patent is extended or adjusted under 35 U.S.C. 154(b) by 263 days.

(21) Appl. No.: 13/126,806

(22) PCT Filed: Oct. 28, 2009

(86) PCT No.: PCT/CL2009/000019

§ 371 (c)(1),
(2), (4) Date: Apr. 29, 2011

(87) PCT Pub. No.: WO2010/048739

PCT Pub. Date: May 6, 2010

(65) Prior Publication Data

US 2011/0203919 A1 Aug. 25, 2011

(30) Foreign Application Priority Data

Oct. 30, 2008 (CL) ..... 3237-2008

(51) Int. Cl.

| | |
|---|---|
| ***C25C 7/00*** | (2006.01) |
| ***C25C 1/12*** | (2006.01) |
| ***B65D 6/40*** | (2006.01) |
| ***B65D 6/24*** | (2006.01) |

(52) U.S. Cl.
USPC ..... 204/278.5; 204/275.1; 205/574; 220/4.12; 220/4.13

(58) Field of Classification Search
USPC ..... 220/4.12, 4.13; 205/574
See application file for complete search history.

(56) References Cited

U.S. PATENT DOCUMENTS

| | | | | |
|---|---|---|---|---|
| 3,876,516 | A | | 4/1975 | Pace et al. |
| 3,966,567 | A | | 6/1976 | Pace et al. |
| 5,066,379 | A | * | 11/1991 | Harry et al. ..... 204/279 |
| 5,855,756 | A | | 1/1999 | Anzalone |

FOREIGN PATENT DOCUMENTS

| | | | |
|---|---|---|---|
| CL | 42760 | * | 5/2001 |
| DE | 1 132 341 B | | 6/1962 |

* cited by examiner

*Primary Examiner* — Harry D Wilkins, III
(74) *Attorney, Agent, or Firm* — Abelman, Frayne & Schwab

(57) ABSTRACT

A modular array of containers placed in parallel for electrolytic solutions used in metals electrolysis processes, particularly for metals electrowinning and electrorefining processes, assemblable from joinable and sealable prefabricated panels with other equal or similar ones, comprising at least a pair of opposite end walls (1, 2), lateral walls (3, 4), a plurality of floor panels (5) and a plurality of intermediate transverse walls (6), the modular array of containers having a common wall between two adjacent containers, the common wall defined by said intermediate transverse walls (6). At least the intermediate walls (6) of the array of containers comprise each one a passage (7, 8) integrated to the wall for the protected feeding and distribution of the loaded electrolytic solution; these walls also being of a reduced wall width in the middle with respect to at least one of its ends and its upper and lower part; said at least one end and upper and lower part of the walls defined by edge formations (9, 10, 11, 12) in which at least one of the formations contains said passage within.

30 Claims, 5 Drawing Sheets

MODULAR CONTAINER ASSEMBLY FOR CORROSIVE SOLUTIONS

FIELD OF THE INVENTION

The present invention relates to a modular array of containers assemblable from prefabricated panels joinable and sealable with other equal or similar ones applied particularly, but not limited to the containment of corrosive solutions, especially for metals electrorefining and electrowinning facilities such as copper, cobalt, zinc and nickel.

PREVIOUS ART

In electrowinning (EW) processes the extraction of metal contained in an acid solution is produced by an electrolytic process in which the metal is deposited from the solution to the cathodes, which are periodically "harvested" to loosen the adhered metal. The process is done in an array of rectangular containers of the electrolytic cells type, arranged in parallel inside the EW plant, with slight separation between each other, forming multiple rows of containers.

Electrorefining (ER) is done in a similar way, although, in contrast to the electrowinning, the metal is recovered via electrolysis from contaminated cathodes and not from a solution bearing the metal. Anyhow, the cells design and the buildings housing them are very similar in both processes. In particular, the container bearing the electrodes (anodes and cathodes) must comply with several requirements:

i) that it be manufactured from one or more materials capable of resisting the corrosive action of the electrolytic solution;

ii) that the material(s) be able to adequately withstand the mechanical loads to which the container is subject to, including the weight of the container itself, the weight of the electrodes, the hydrostatic pressure of the electrolyte and the thermal gradient from the difference between the inside and outside of the container which can vary from 25° C. to 50° C. depending on whether the process is EW or ER and whether the building housing the cells is open or closed; and iii) that the geometry of the container and mounting system allow precise leveling and alignment of the cells array such that it guarantees compliance with the low dimension tolerances of the design, considering that the trend nowadays is increasingly inclined towards containers of large lengths, which forces to have complex and high cost equipment and methods.

Previous art containers generally correspond to monolithic designs; that is bodies molded in one piece, typically made of polymeric concrete for which molds especially manufactured for this purpose are generally used. In these cases, because the minimum curing time required before the cell can be demolded and handled without it undergoing structural damages is of eight hours, only one cell per day can be manufactured per mold, which forces to have two or more molds to produce more than one cell per day.

This type of manufacturing has the inconvenience that due to the dimension requirements mentioned before, the molds are complex and its manufacturing usually takes several months and thus their cost is high. Another drawback is that the containers weight several tons and therefore handling requires heavy equipment. Due to the large volume and weight, transport cost to mine sites is sometimes a limiting factor when evaluating the feasibility of the project.

An alternative of electrolytic cell fabrication is described in the Chilean patent 42.760, which discloses structures manufactured with known molding techniques using smaller and less complex molds than the ones used for monolithic containers. Furthermore, these structures can be easily and cost efficiently stacked and transported. The assembly of the container is also very simple since low weight and volume units are handled that are assembled with other equal or similar ones, originating one or multiple corrosion resistant containers that can be of diverse shapes and sizes.

The constructive form of patent 42.760 allows the assembly of modular arrays made of a plurality of cells installed in parallel with a common wall between adjacent cells, which reduces the number of walls to manufacture, with the consequent manufacturing savings. Furthermore this configuration provides for reduction of temperature losses of the acid solution by eliminating the empty space between said adjacent walls, thus reducing operational costs of the electrolytic plant in terms of fuel consumption to heat the electrolyte.

In a typical electrolytic cells assembly for EW according with the previous art, once the containers are assembled and supported and leveled on adequate supporting structures such as concrete beams or columns, the piping system is installed to feed and distribute the loaded electrolyte and discharge the spent electrolyte; then the isolating and spacing component of the electrodes or capping boards and the conductive bars and electric connections are mounted, and finally the electrodes are placed.

The acid solution or electrolytic solution feeding and distribution system for EW or ER processes generally comprises pipes, generally made of thermoplastic material such as PVC, that are extended toward the inside of the container and affixed by diverse means to its internal walls. This traditional way of supplying electrolyte has the drawback of its high cost and a the high damage incidence on the pipes, particularly during mounting and periodical removal of the electrodes to recover the deposited metal and/or for cleaning purposes. Yet there are some systems that try to overcome these inconveniences.

Patent EP 0 431 313 depicts a container for corrosive electrolytes having a covered vertical channel or cast-in pipe for electrolyte feeding.

International application No. WO 01/32962 depicts an electrolytic cell which in one of its embodiments has a manifold for feeding and distributing the solution of electrolyte into the cell, the manifold arranged on a recess extending along the whole internal side of the lateral wall of the cell. It also depicts a cantilever pipe arrangement at both sides of the common wall and protected by the spacing and isolating plate, appropriate for arrays of containers with a common wall between adjacent cells.

Alternatively, an embodiment is mentioned in which the manifold would be mounted inside the lateral walls of the cell. However, neither explanations nor illustrations of any details of this variation are included.

This last embodiment would be preferable because it offers more protection and is cost efficient with regard to assembly and maintenance due to the fact that the feeding and distribution pipe is integrated into the walls of the cells.

Consequently, it would be desirable to have a modular array of containers placed in parallel for electrolytic processes, especially for electrowinning and electrorefining, that combines the advantages of the constructive disposition disclosed in the Chilean patent 42.760 and the advantages of the integrated protected electrolyte feeding and distribution systems. Moreover, it would be desirable that the modular array of containers be assemblable from prefabricated structures joinable and sealable with other equal or similar ones, not only having one common wall between adjacent containers and allowing the addition of an integrated protected electrolyte feeding and distribution system, but also rendering compatible the convenience of reduced weight in at least said common walls, for example by reducing its width in order to reduce the weight of the array, with the need for structural stability and mechanical resistance of the array and the need to keep a wall width that will allow for the mounting of the spacing and isolating components of the electrodes.

SUMMARY OF THE INVENTION

In order to achieve the above, a modular array of containers placed in parallel has been developed for electrolytic solutions used in metal electrolysis processes, particularly for metal electrowinning and electrorefining processes, that is assemblable from prefabricated panels joinable and sealable with other equal or similar ones, the modular array of containers comprising at least on pair of opposite end walls, lateral walls and a plurality of transverse intermediate walls and floor panels, wherein the intermediate walls define a common wall between two adjacent containers, the modular array of containers characterized in that at least the intermediate walls comprise each one a passage integrated to the wall for the protected feeding and distribution of the electrolytic solution, and in that said walls are of a reduced wall width at the center with respect to at least one of its ends and upper and lower part, said at least one end and upper and lower part of the walls defined by border formations, wherein at least one of the formations contain said passage within.

The so designed array supplies the required structural stability and mechanical resistance of the array and allows for the mounting of electrodes spacers and isolators on the upper surface of said walls.

Preferably not only the intermediate walls have said arrangement and passage inside but also the lateral walls of the array of containers have said arrangement.

The passage can be defined by a pipe embedded in the wall material, it can be defined by a conduit molded inside the border formations during the molding process of the wall or it can be formed by any other known method. Besides, it can have multiple arrangements.

According to a simple embodiment of the invention the passage comprises only one vertical main section inside a border formation extending in the vertical direction in one of the ends of the wall. Alternatively this simple passage comprises a single horizontal section extending horizontally along the inside of the border formation of the upper part of the wall.

In a progressively more complex way the passage comprises one extension extending along the inside of at least one of the other border formations, even along all the border formations, which can be formed at both ends of the wall besides the upper and lower part of it.

Moreover, the main section and/or extensions of the passage can be centered inside the border formations or have one or more parallel bifurcations or branches in the border formation (if the passage comprises only one main section) or in at least one of the formations, preferably two parallel branches formed adjacent to the external surface of the formation(s) at both sides of the wall.

Preferably the passage has an upper entry to connect to a supply source of the electrolytic solution and at least one exit hole of the electrolyte into the container, preferably multiple exit holes and more preferably multiple electrolyte exit holes placed so that at least one hole faces the space between adjacent electrodes thereby assuring an even distribution of the electrolytic solution.

The passage entry is preferably connected to the electrolyte supply source via a through hole or a cut in the end wall adjacent to said entry so that through said hole or cut the passage connects with the electrolyte supply source pipes.

Aligning and fixing means of the lateral and intermediate walls with the end walls are supplied in the lateral, intermediate and end walls, while in the end walls fixing means between each other are provided.

In turn the floor panels have means for snugly receiving the lateral walls and intermediate walls and supporting and anchoring means to support, anchor and level the panels on supporting columns or beams.

The walls and floor panels that comprise the array of containers are quadrangular and are preferably manufactured with thermoplastic anticorrosion compositions and thermostable resins such as those disclosed in the Chilean Invention Patent N° 42.760. In order to improve the insulating properties of the walls and floor panels, they are preferably made from prefabricated panels with a core defined by an empty space or a space filled with an insulating material.

A rational assembling sequence is followed to assemble the containers. First the floor panels are mounted on the supporting columns or beams where elements compatible with the supporting and anchoring means of the floor panels have been left in place. In an original fashion, these anchoring and leveling elements consist of a leveling plate on each column and a coupling U type bolt or individual coupling bolts integrated to the column, that match in the supporting and anchoring means of the floor panels so as to anchor and level the floor panel to the column with said regulating bolts and nuts.

In a second step the coupling of said panels is sealed with means arranged for said purpose, wherein said means are compatible with the construction material of the panel surfaces to be sealed.

In a third step the walls of the array of containers are mounted, which may indistinctively be an end wall followed by an intermediate wall or vice versa, such that when they are connected with each other with the aligning and fixing means provided thereof, they are left firmly joined together and resting on each other, and leveled on the floor panels. The sequence is continued in this way until all the walls comprising the array of containers, including the lateral ones, are leveled and connected firmly with each other.

In order to assure the water tightness of the containers, as a last step of the assembly seals are applied in the intersections or joining areas of the walls and of the walls with the floor panels. The seals can be made from materials of the thermoplastic or thermostable group compatible with the material of the surfaces of the walls and panels to be sealed and wherein the application method of said materials can be any one of those known and existing in the practice.

Alternatively or additionally elastomeric seals can be applied in the joining areas of the panels, in formations in their edges.

DETAILED DESCRIPTION OF THE INVENTION

Figure 1:
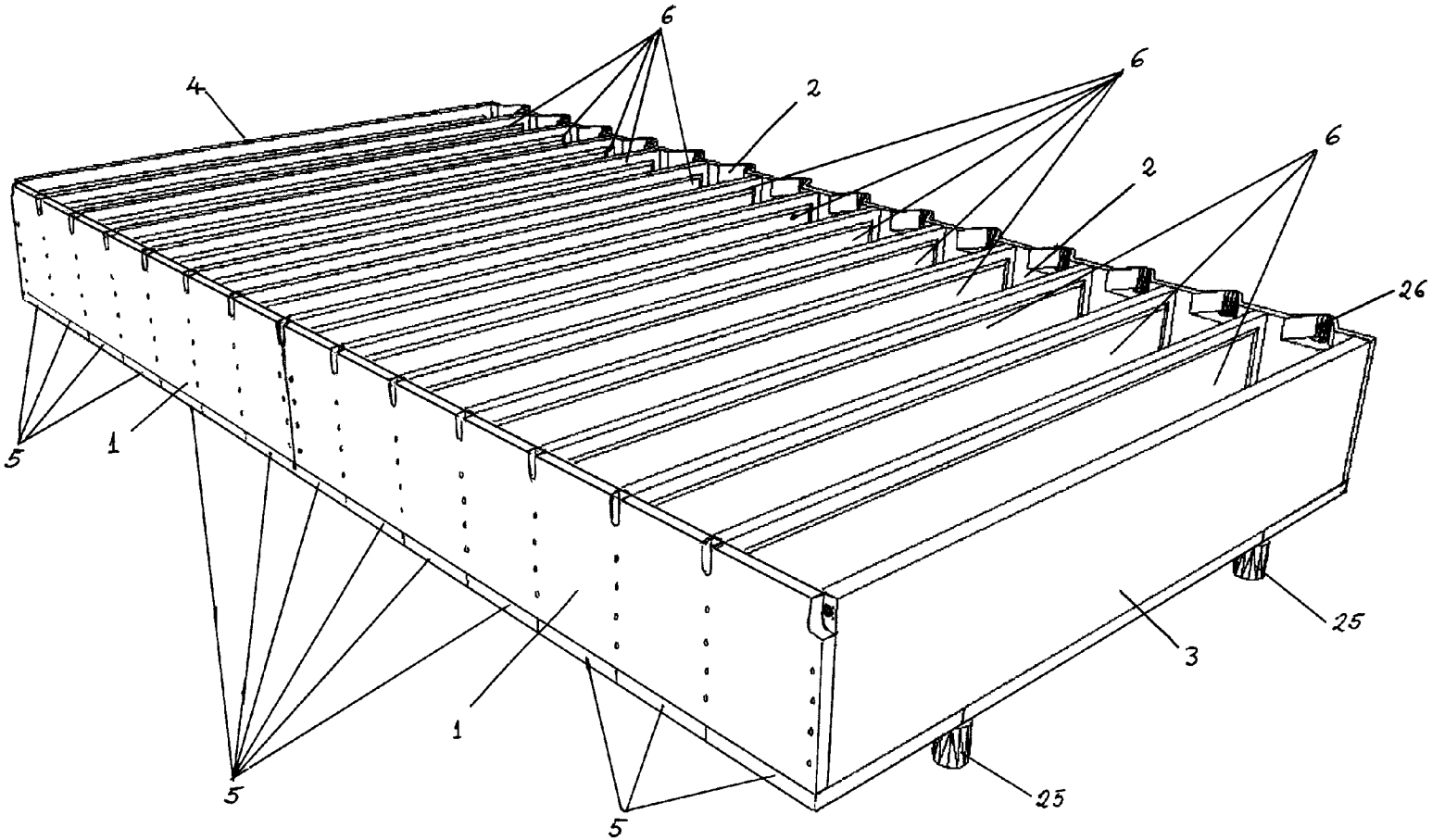
FIG. 1 is a front view in perspective of a preferred embodiment of the modular array of containers according to the principles of this invention.
Figure 2:
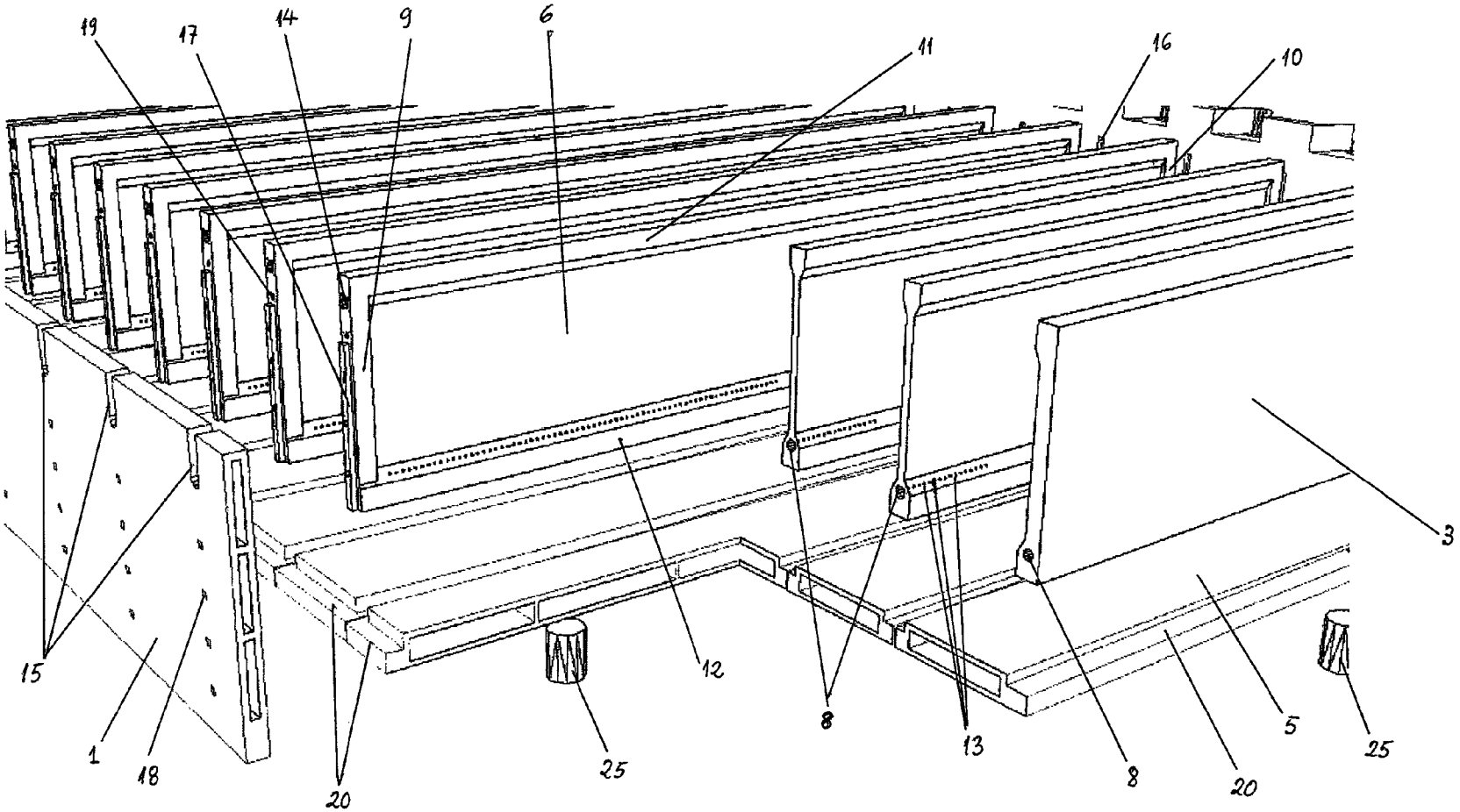
FIG. 2 is a partial exploded view of the modular array of containers of FIG. 1 depicting an end panel, three floor panels (one lateral and two inner ones), the lateral wall and the two closest intermediate panels in partial sectional view.

FIGS. 1 and 2 show a preferred embodiment of the modular array of containers placed in parallel according to the invention with its distinct elements: at least one pair of opposite end walls (1, 2)—in the embodiment shown two at each endpoint can be observed—, lateral walls (3, 4), a plurality of floor panels (5) and a plurality of intermediate transverse walls (6), which are sealed together and where said intermediate transverse walls (6) conform a common wall between two adjacent containers. The array is supported on columns (25) and end walls (2) of one end of the array of containers have overflow boxes (26) formed in said walls in a number equivalent to the number of containers, so as to discharge the electrolytic solution.

As can be better seen in FIG. 2 the edge formations (9, 10, 11, 12) extend vertically at both end of the intermediate walls (6) and horizontally all along the upper and lower part of said walls (6). Each edge formation (9, 10, 11, 12) has a symmetric design with respect to the longitudinal plane of symmetry of each wall so that the intermediate walls (6) have a double "T" shaped transverse profile.

The lateral walls (3, 4) also have edge formations (9, 10, 11, 12) but only to one side of the longitudinal plane of symmetry of the wall so that the lateral walls (3, 4) have a "C" shaped transverse profile.

Figure 3:
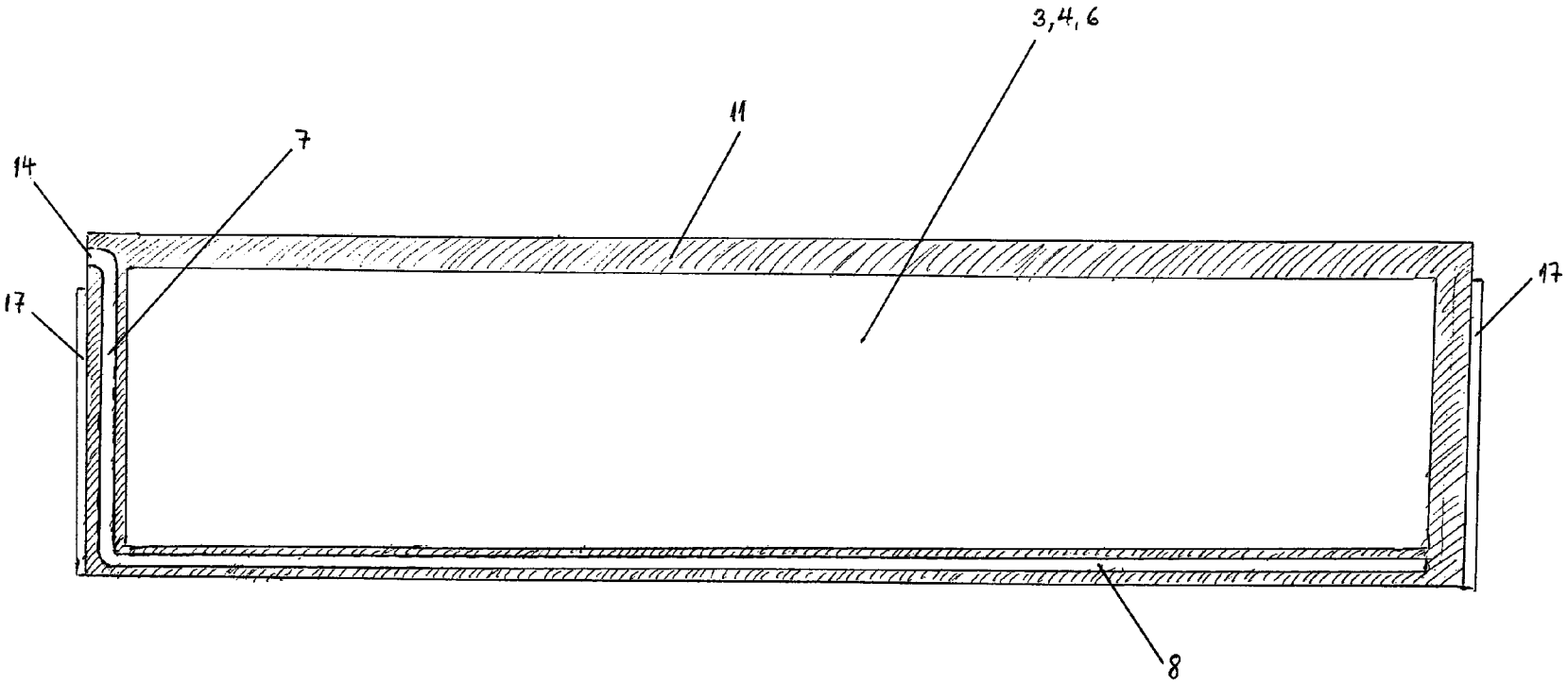
FIG. 3 is a longitudinal sectional view of a wall that can be intermediate or lateral, of the modular array of containers of FIGS. 1 and 2, depicting a passage inside to feed and distribute the electrolyte.

Likewise, both the intermediate walls (6) and the lateral walls (3, 4) have a passage (7, 8) to feed and distribute the electrolytic solution that in the embodiments of FIGS. 1 to 3 comprises a sole conduit centered in the edge formations (9, 12) that define one ends and the lower part of said walls (3, 4, 6). According to these Figures, the passage (7, 8) has an upper entryway (14) to connect with the electrolytic solution supply source and multiple holes (13) for the exit of the electrolyte into each container.

The passage comprises a main vertical section (7) inside the formations (9) that define one of the endpoints of the walls (3, 4, 6) and a single arm (8) extending all along the inside the formations (12) that define the lower part of the walls (3, 4, 6).

Cuts (15) in the end walls (1) adjacent to the entry (14) of each passage (7, 8) allow connection of the passages with the manifold of the electrolytic solution supply source.

To join the lateral (3, 4) and intermediate (6) walls with the end walls (1, 2) aligning means are provided, comprised by compatible and mutually matching grooves (16) and protrusions (17).

Furthermore, the lateral (3, 4) and intermediate (6) walls have complementary fixing means together with the end walls (1, 2), comprising transverse wise through-holes (18) in the end walls (1, 2) and bores (19) aligned with said through-holes (18) at the ends of the lateral (3, 4) and intermediate (6) walls, wherein the through-holes (18) and the bores (19) are adapted to receive bolts (not shown) that are introduced from the outside of the end walls (1, 2) and are tightened to a nut (not shown) or similar compatible jack connector type element inserted in said bores (19).

Fixing means (not shown) are arranged to join the end walls (1, 2) with each other, which generally comprise side recesses with bores on their bottom to put a fixing plate with bolts in each recess.

The floor panels (5) have a perimeter drop or step (20) for snugly receiving the lateral walls (3, 4) and the intermediate walls (6). The perimeter drop or step (20) has a slope that facilitates and improves drainage of the electrolyte toward the overflow box (26).

Figure 4:
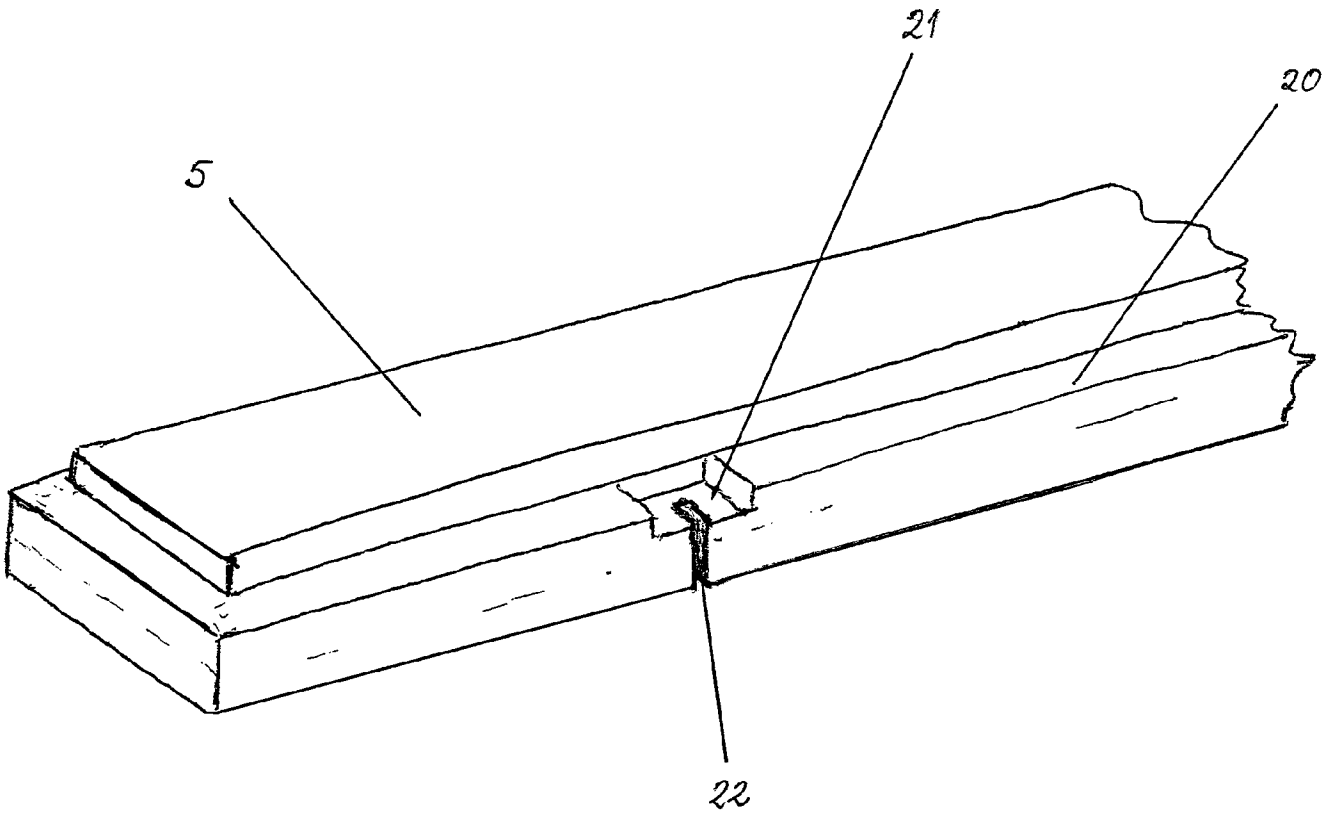
FIG. 4 is an enlarged partial view of a floor panel of the modular array of containers of the invention, showing in detail the means to snugly receiving the lateral walls and the intermediate walls and showing the support and anchoring means to support, anchor and level these over supporting columns or beams.
Figure 5:
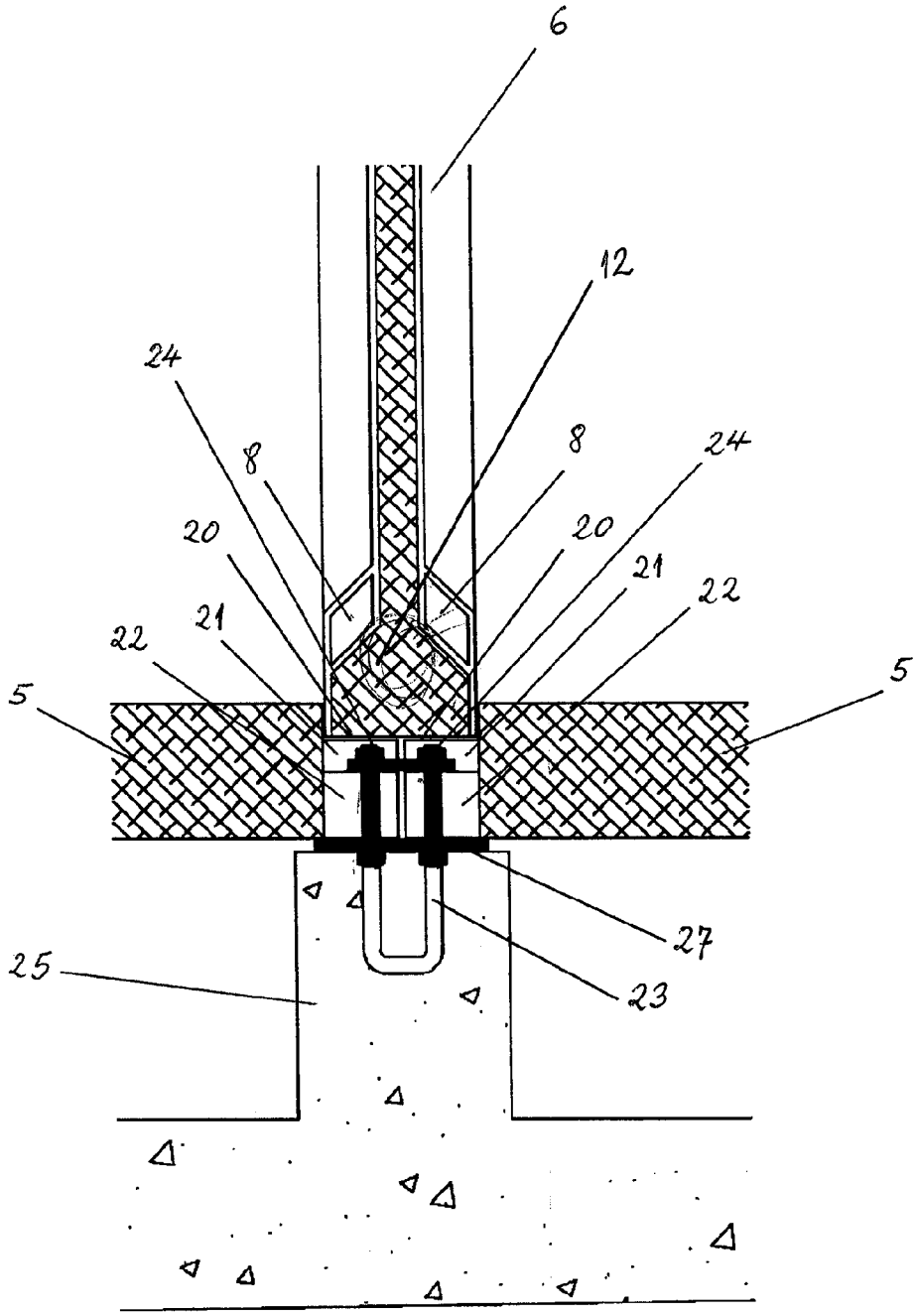
FIG. 5 is an enlarged partial view in cross section of the modular array of containers according to an alternative embodiment of the invention, depicting one intermediate wall is received on the floor panels and where these floor panels are supported, anchored and leveled on a column.

On the other hand, as shown in detail in FIGS. 4 and 5, the supporting and anchoring means to support, anchor and level the floor panels (5) on the columns (25) comprise recesses (21) on the slope (20) of the floor panels (5). Each recess (21) is aligned and faces a corresponding similar recess (21) in the next floor panel (5). Further, each recess (21) has a vertical through slot (22) to receive the arms of a U type connecting bolt (23) integrated into the column (25) and regulating nuts (24) for tightening and fixing the floor panel (5) on a leveling plate (27) fixed to the upper surface of the column (25).

FIG. 5 depicts a second embodiment of the invention in which the passage for feeding and distributing the electrolyte comprises a pair of parallel arms (8) formed adjacent to the external surface of the formation (12) at both sides of the lower part of the wall.

The invention claimed is:

1. A modular array of containers placed in parallel for electrolytic solutions used in metal electrolysis processes, particularly for metal electrowinning and electrorefining processes, assemblable from prefabricated panels joinables and sealables with others equal or similar ones, the modular array of containers comprising at least a pair of opposite end walls (1, 2), lateral walls (3, 4), a plurality of floor panels (5) and a plurality of intermediate transverse walls (6), wherein said intermediate transverse walls (6) define a common wall between two adjacent containers, characterized in that at least the intermediate walls (6) each comprise a passage (7, 8) integrated into the wall for the protected feeding and distribution of electrolytic solution, and in that said walls are of a reduced wall width in the middle with respect to at least one of its ends and upper and lower part, said at least one end and upper and lower part of the walls defined by edge formations (9, 10, 11, 12), wherein at least one of the formations has said passage within.

2. Modular array of containers placed in parallel according to claim 1, characterized in that, similarly to the intermediate walls (6), the lateral walls (3, 4) also each have an integrated passage (7, 8) for the protected feeding and distribution of the electrolytic solution and edge formations (9, 10, 11, 12).

3. Modular array of containers placed in parallel according to claim 2, characterized in that the lateral walls (3, 4) have a "C" shaped transverse profile.

4. Modular array of containers placed in parallel according to claim 1, characterized in that the intermediate walls (6) have a double "T" shaped transverse profile.

5. Modular array of containers placed in parallel according to claim 1, characterized in that both ends of the wall (3, 4, 6) are defined by edge formations (9, 10).

6. Modular array of containers placed in parallel according to claim 5, characterized in that the passage comprises a vertical main section (7) extending vertically inside the edge formation (9, 10) defining one of the wall ends.

7. Modular array of containers placed in parallel according to claim 6, characterized in that the passage additionally comprises one or more extensions (8) extending inside of at least one of the rest of the formations (11, 12).

8. Modular array of containers placed in parallel according to to claim 7, characterized in that the passage (7, 8) in at least one of the formations (9, 10, 11, 12) comprises one or more parallel branches or arms.

9. Modular array of containers placed in parallel according to claim 8, characterized in that the two parallel arms are formed adjacent to the external surface of the formation (s) (9, 10, 11, 12) at both sides of the wall.

10. Modular array of containers placed in parallel according to claim 5, characterized in that the passage comprises a horizontal main section (7) extending horizontally inside the edge formation (11) defining the upper part of the wall and/or formation (12) defining the lower part of the wall.

11. Modular array of containers placed in parallel according to claims 10, characterized in that the passage (7, 8) comprises multiple exit holes (13) of the electrolyte into the container.

12. Modular array of containers placed in parallel according to claim 11, characterized in that the multiple holes are arranged such that there is at least one hole facing the space between adjacent electrodes.

13. Modular array of containers placed in parallel according to claim 1, characterized in that the passage (7, 8) has an upper entry (14) to connect to a supply source of the electrolytic solution and to at least one exit hole (13) of the charged electrolyte into the container.

14. Modular array of containers placed in parallel according to claim 13, characterized in that the upper entry (14) of the passage (7, 8) connects with pipes of the supply source of the electrolytic solution through a through hole or a cut (15) in the end wall adjacent to the entry (14).

15. Modular array of containers placed in parallel according to claim 1, characterized in that the passage (7, 8) is defined by a tube embedded in the material of the wall.

16. Modular array of containers placed in parallel according to claim 1, characterized in that the passage (7, 8) is defined by a conduit molded inside the wall.

17. Modular array of containers placed in parallel according to claim 1, characterized in that the lateral (3, 4), intermediate (6) and end (1, 2) walls have aligning means (16, 17) of the lateral (3, 4) and intermediate (6) walls with the end walls (1, 2).

18. Modular array of containers placed in parallel according to claim 17, characterized in that the aligning means are comprised by grooves (16) in the end walls (1, 2) and protrusions (17) in the laterals (3, 4) and intermediate (6) walls, said grooves and protrusions being compatible and mutually matching.

19. Modular array of containers placed in parallel according to claim 1, characterized in that the lateral (3, 4), intermediate (6) and end (1, 2) walls have fixing means (18, 19) of the lateral (3, 4) and intermediate (6) walls with the end walls (1, 2).

20. Modular array of containers placed in parallel according to claim 19, characterized in that the fixing means comprise transverse wise through-holes (18) in the end walls (1, 2) and bores (19) aligned with said through-holes (18) at the ends of the lateral (3, 4) and intermediate (6) walls to receive bolts that are tightened to a nut or a similar compatible jack connector type element inserted in said bores (19).

21. Modular array of containers placed in parallel according to claim 1, characterized in that the end walls (1, 2) have fixing means with each other.

22. Modular array of containers placed in parallel according to claim 21, characterized in that the fixing means of the end walls with each other comprise side recesses with bores on the bottom to put a fixing plate with bolts in each recess.

23. Modular array of containers placed in parallel according to claim 1, characterized in that the floor panels (5) have means (20) for snugly receiving the lateral and intermediate walls and supporting and anchoring means (21, 22) to support, anchor and level the floor panels (5) on columns (25) or other similar supporting elements on the floor.

24. Modular array of containers placed in parallel according to claim 23, characterized in that the means for snugly receiving the lateral (3, 4) and intermediate (6) walls comprise a perimeter drop or step (20).

25. Modular array of containers placed in parallel according to claim 24, characterized in that the perimeter drop or step (20) has a slope that facilitates and improves the drainage of the electrolyte toward the overflow box (26).

26. Modular array of containers placed in parallel according to claim 23, characterized in that the supporting and anchoring means of the floor panels (5) comprise recesses (21) in the perimeter drop (20) of the floor panels (5), wherein each recess (21) is aligned and facing a corresponding similar recess (21) in the next floor panel (5) and each recess (21) has a vertical through slot (22) designed to receive the arms of a U type connecting bolt (23) integrated into the column (25) and nuts (24) for tightening and fixing the floor panel (5) to the column (25), a leveling plate (27) being fixed to the upper surface of the column (25).

27. Modular array of containers placed in parallel according to claim 1, characterized in that the end wall(s) (2) of one end of the modular array of containers have overflow boxes (26) molded in a number equivalent to the containers in parallel of the modular array to drain the electrolyte.

28. Modular array of containers placed in parallel according to claim 1, characterized in that the walls (1, 2, 3, 4, 6) and the floor panels (5) are made of anticorrosive thermoplastic compositions and thermostable resins.

29. Modular array of containers placed in parallel according to claim 1, characterized in that elastomeric seals are disposed at the joining areas of the walls (1, 2, 3, 4, 6), housed in the edges of the walls (1, 2, 3, 4, 6).

30. Modular array of containers placed in parallel according to claim 1, characterized in that seals are provided in the intersections or joining areas of the walls of (1, 2, 3, 4, 6), of the walls with the floor panels, and of the floor panels with each other, the seals made of a material from the thermoplastic or thermostable group compatible with the material of the surfaces of said intersections or joining areas.

* * * * *